US005097973A

United States Patent [19]

Spencer

[11] Patent Number: 5,097,973

[45] Date of Patent: Mar. 24, 1992

[54] RAILCAR ARTICULATED CONNECTOR AND WEDGE SHIM THEREFORE

[75] Inventor: Charles P. Spencer, Staunton, Ill.

[73] Assignee: Amsted Industries Incorporated, Chicago, Ill.

[21] Appl. No.: 673,344

[22] Filed: Mar. 22, 1991

[51] Int. Cl.[5] ..... B61G 9/00

[52] U.S. Cl. ..... 213/50; 213/56

[58] Field of Search ..... 213/50, 56, 58, 60, 213/61, 62 R, 62 A, 75 R, 77; 105/3, 4.1, 4.2, 4.3

[56] References Cited

U.S. PATENT DOCUMENTS

| | | | |
|---|---|---|---|
| 3,716,146 | 2/1973 | Altherr | 213/75 R |
| 4,258,628 | 3/1981 | Altherr | 213/75 R |
| 4,336,758 | 6/1982 | Radwill | 213/75 R |
| 4,456,133 | 6/1984 | Altherr et al. | 213/62 R |
| 4,549,666 | 10/1985 | Altherr et al. | 213/62 R |
| 4,593,827 | 6/1986 | Altherr | 213/50 |
| 4,593,829 | 6/1986 | Altherr | 213/75 R |
| 4,700,853 | 10/1987 | Altherr et al. | 213/50 |
| 4,946,052 | 8/1990 | Kaim et al. | 213/75 R |
| 5,000,330 | 3/1991 | Kaim et al. | 213/61 |
| 5,035,338 | 7/1991 | Kaufhold et al. | 213/50 |

FOREIGN PATENT DOCUMENTS

| | | | |
|---|---|---|---|
| 0961446 | 1/1975 | Canada | 213/62 R |

*Primary Examiner*—Douglas C. Butler
*Assistant Examiner*—Mark T. Le
*Attorney, Agent, or Firm*—Edward J. Brosius; F. S. Gregorczyk

[57] ABSTRACT

An improved articulated railcar connection and wedge shim wherein the wedge shim has a plurality of steps formed in the sides thereof upwardly from the narrow wedge bottom to present successive lifting surfaces accessible from inspection portals formed in the connection.

4 Claims, 2 Drawing Sheets

RAILCAR ARTICULATED CONNECTOR AND WEDGE SHIM THEREFORE

This invention relates to the art of railcar connectors especially articulated connectors; and more specifically is directed to an improved wedge component that functions to move so as to fill up space created between parts due to wear.

BACKGROUND OF THE INVENTION

Connectors for railcars are usually pivotally attached to each end of a car center sill. A convex end of a male connector part normally rests against a follower block held within a female sill pocket casting that is mounted within the car sill to withstand longitudinal forces tending to thrust the connector into the sill (compressive or buff loading). The connector is held from being withdrawn from the sill by pulling forces (draft loading) by a pin or drawbar or by a collar that is spaced from the follower block. Several types of connectors are available to extend between successive railcars such as couplers, drawbars and articulated connectors wherein there is a single pivotal connection between male and female members that are rigidly attached to the adjacent ends of successive car platforms.

In newly assembled connectors the clearances between the aforementioned parts are minimal and there is virtually no slack or movement of the parts longitudinal of the car when forces on the connectors are reversed, as occurs each time the car is accelerated or decelerated. However, usage induces wear on various parts and gradually spaces will be created. Such spaces are known as slack. Slack is undesirable as it causes repetition and magnification of impact forces when a train of cars is accelerated and decelerated. Yet a degree of slack in each pivotable connection is needed for the purposes of assembling and disassembling the parts, which must be done from time to time.

Ordinarily in freight car construction slack is compensated and taken up by locating a wedge shaped shim between two of the connector parts, usually between the follower block and a closed end of a sill pocket as shown in prior U.S. Pat. Nos. 3,716,146, 4,456,133 and 4,549,666. As will be seen in the prior art, the wedge usually inserts downwardly by gravity although it can be spring loaded in other directions. In articulated connectors a wedge is placed between the follower block and an end wall of the female member as shown in prior U.S. Pat. Nos. 4,258,628, 4,336,758 and 4,593,829. In operation the wedge becomes further inserted to maintain compression between the parts as wear enlarges the spaces.

The wedge must be replaced or the connector otherwise serviced when the wedge becomes fully inserted. Ordinarily a viewable wear indicator is provided on the wedge side. The most common indicator has been a groove cut on a tab extending from each side of the wedge; and portals or holes are located in the sill or articulated connector near the bottom of the female pocket.

When it becomes necessary to disassemble such connections the wedge must be partially withdrawn so as to release compression and permit the parts to be removed. Heretofore it has been necessary for mechanics to insert a tool, such as a prybar, against the bottom or a side tab of the wedge and lever it outward. The wear indicator portals in the sides of some structures have been utilized to provide access for such tools; and the aforementioned tabs at each wedge side have been contact points for such inserted tools. An example of such construction for articulated connectors is illustrated in U.S. Pat. No. 4,593,829.

However, it will be understood that the location of such tabs has been primarily chosen to indicate a fully inserted (worn) position of the wedge with the result that it has been very difficult to position a tool for adequate leverage against the tabs when the wedge is nearing but has not reached a fully inserted position.

In some connector constructions this is not a formidable problem as a broad access opening may be available from directly beneath a gravity wedge, and it is a simple matter to insert a tool directly against the wedge bottom and force it upward. Indeed it has been proposed to include an extension piece on some wedge designs to act as a wear indicator and also to enable the wedge to be withdrawn without a separate tool. An example of such a wedge and extension is shown in U.S. Pat. No. 4,946,052. However, these features are not compatible with all connector arrangements particularly where access holes or view ports at the sides must be relied on for access. For example for strength reasons the articulated connectors illustrated in the aforelisted patents are not suitable for bottom openings but do contain side inspection portals.

SUMMARY OF THE INVENTION

Accordingly, it is a principal object of the present invention to provide an improved wedge shim having multiple tool contact locations constructed thereon.

It is another object of the present invention to provide an improved wedge shim having multiple tool contact surfaces formed on each side thereof.

It is sill another object of the present invention to provide an improved articulated railcar connector having a wedge shim with multiple tool contact surfaces at both sides of the wedge that are easily reached by tools inserted through standard access ports in the lower sides of a female member.

Briefly stated the invention incorporates a multiple step construction between the lifting tab at each side of a wedge shim and the narrow bottom of the wedge so as to provide a plurality of lifting surfaces that will align with a wear observation port as the wedge approaches full insertion.

BRIEF DESCRIPTION OF THE DRAWINGS

Other objects and advantages of the invention will become apparent upon reading the following detailed description in conjunction with the drawings wherein.

DESCRIPTION OF A PREFERRED EMBODIMENT

Figure 1:
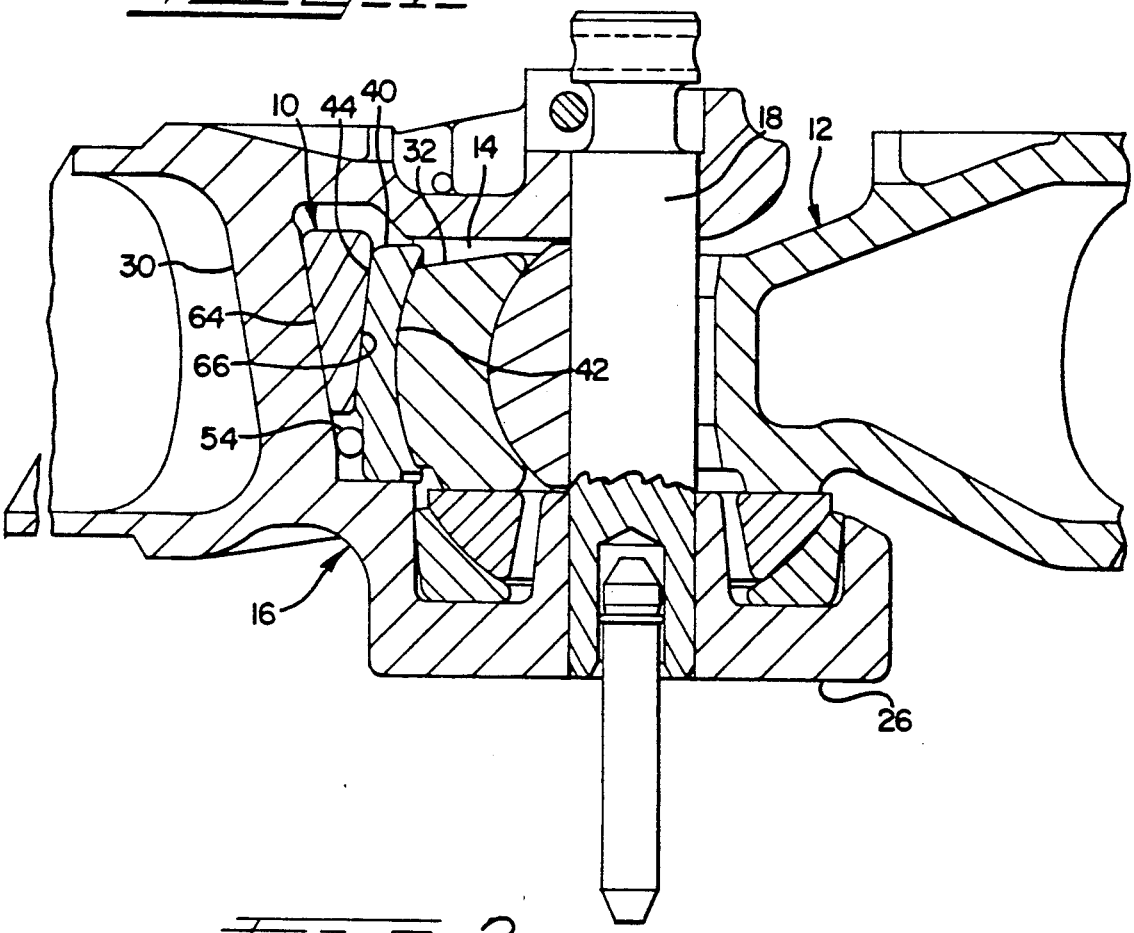
FIG. 1 is a sectional side elevation view of an articulated connector for railcars showing the location of a wedge shim and other parts.
Figure 2:
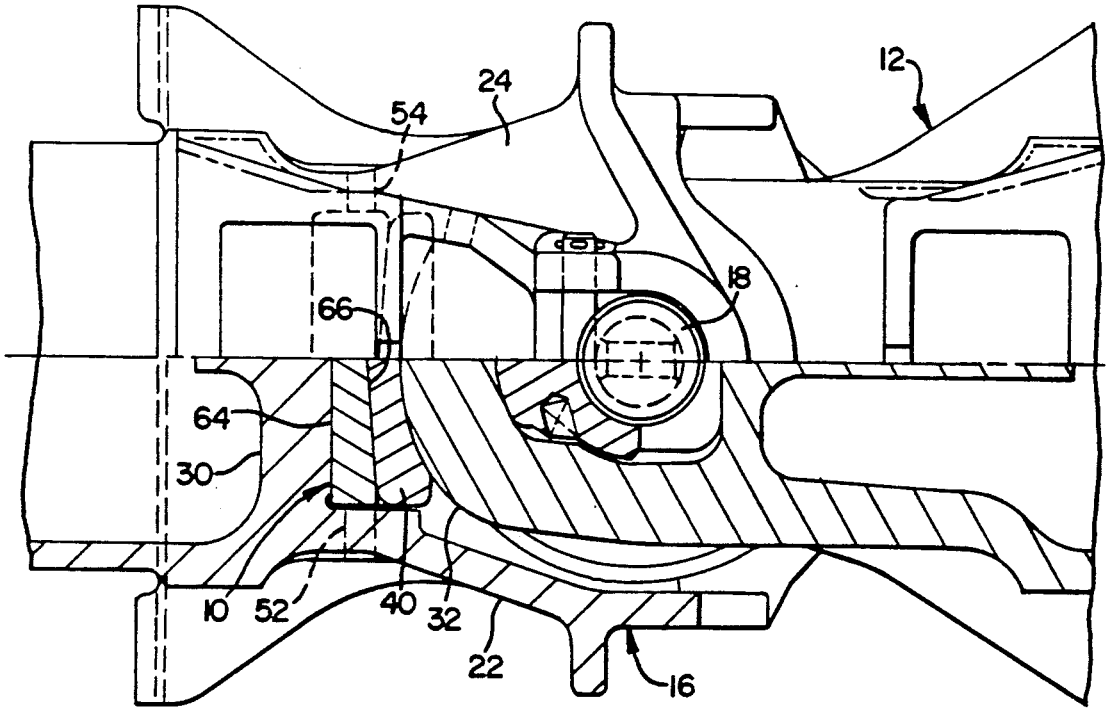
FIG. 2 is a plan view in partial section of the articulated connector of FIG. 1.
Figure 4:
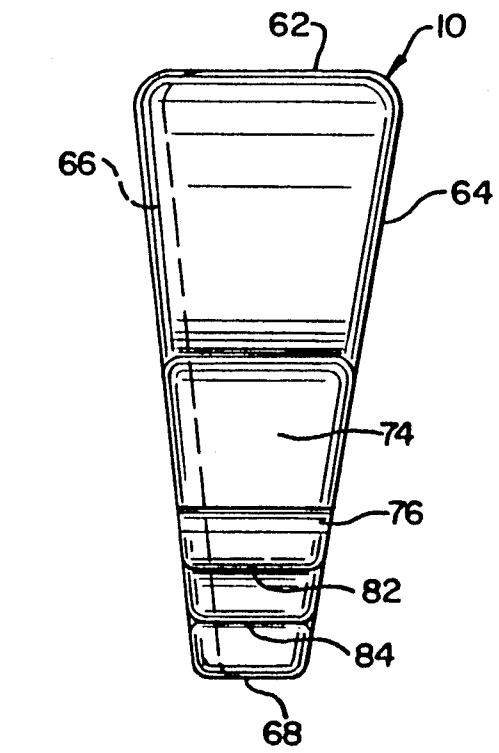
FIG. 4 is a side view of the wedge shim of FIG. 3.
Figure 3:
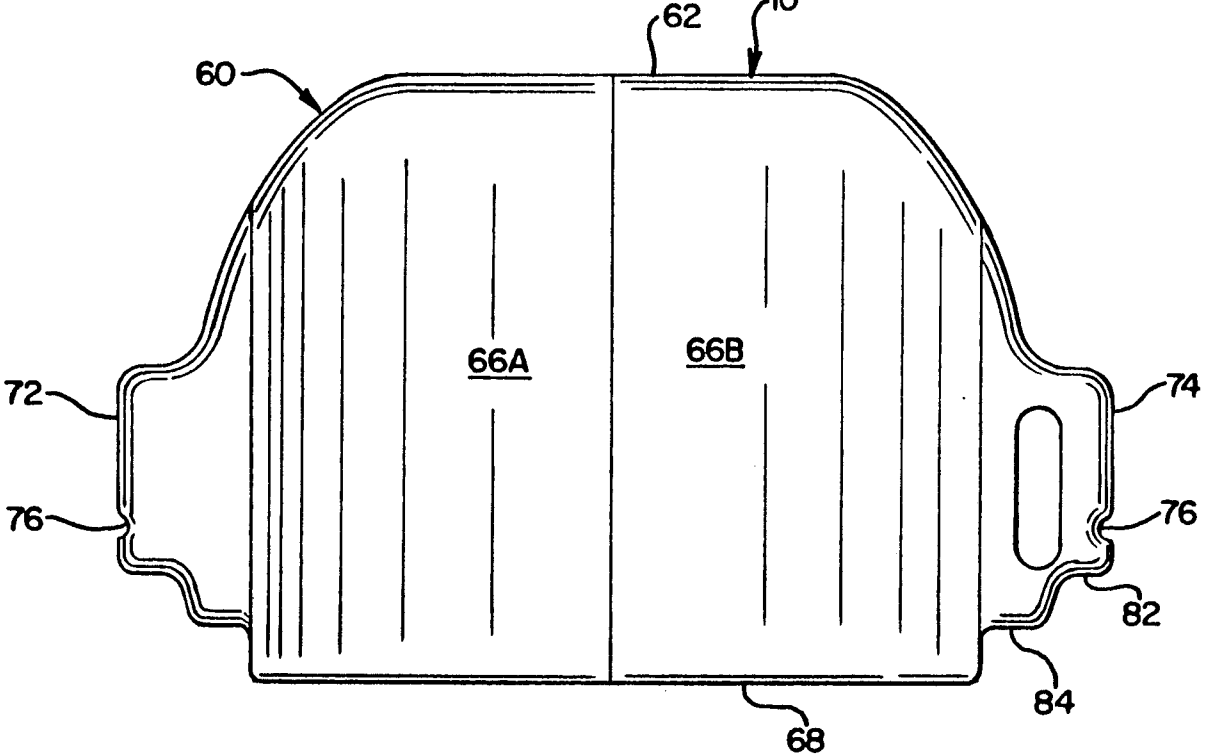
FIG. 3 is an end view of a wedge shim according to the present invention.

While the wedge shim generally 10 illustrated in FIGS. 3 and 4 may be combined with other types of railcar connections, the preferred embodiment was specifically devised for utilization in the articulated connector illustrated in FIGS. 1 and 2 wherein a male member generally 12 is received within a hollow pocket 14 and held by a vertical pin 18 in a female member generally 16.

The female member has a bottom enclosing structure that includes side walls 22, 24 and a downwardly extending exterior boss 26 designed to rest upon a center plate of a car truck (not shown); and the pin 18 extends vertically through both the male and female members 12, 16 centrally of the boss 26. Female pocket 14 terminates in an inclined end wall 30 extending between the side walls 22, 24 and spaced from both the pin 18 and an arcuate outer end 32 of the male member 12. Arrayed between the end wall 30 and outer end 32 are the wedge 10 and a bearing block generally 40. It will be seen that bearing block 40 has a concave rear bearing surface 42 abutting the arcuate outer end 32 of male member 12 and an opposite forward face 44 which, in the illustrated embodiment, consists of two angled surfaces. Wedge 10 is positioned within the pocket 14 between the inclined end wall 30 and the forward face 44 of bearing block 40.

It will be understood that in some connector constructions either one or both of the end wall 30 and the forward face 44 of bearing block 40 may be inclined and the wedge suitably shaped. Also the abutting pairs of surfaces of the end wall 30, wedge 10 and bearing block 40 may be planar from side to side or they may comprise angled surfaces (as shown in FIGS. 2–4 for the surfaces between the bearing block 40 and wedge 10). At least one pair of angled surfaces is believed advantageous to hinder rotation of the wedge 10 and/or bearing block 40.

Inspection or viewing portals 52, 54 are located in the respective side walls 22, 24 adjacent the bottom of end wall 30. As previously explained portals 52, 54 allow inspection of the wedge position and also provide access for tools to lift the wedge for disassembly when maintenance is required.

The preferred wedge 10, illustrated in FIGS. 3 and 4, includes a tapered body generally 60 having a relatively broad top 62 and front and rear bearing surfaces 64, 66 that taper to a relatively narrow bottom 68. For purposes of orientation the wedge front bearing surface 64 is intended to abut the pocket end wall 30 and thus is a single plane for the assembled structure illustrated in FIGS. 1 and 2. The wedge rear bearing surface 66 is intended to abut the angled forward face 44 of the bearing block 40 and thus comprises two flat surfaces 66A and 66B angled at the vertical center line of the wedge.

In FIG. 3 it will be seen that the wedge top 62 curves downwardly at each side to tabs 72, 74; and a groove 76 is formed across the lower portion of each tab 72, 74. The purpose of the grooves 76 is to provide an indicator, visible through the inspection portals 52, 54, that signals that the wedge has become or is approaching maximum insertion and that maintenance is necessary. Beneath each tab 72, 74 a plurality of at least two steps are provided with lifting surfaces 82, 84 parallel to the wedge bottom 68. Thus during the early life of the assembly, before the wedge bottom 68 becomes inserted to the level of the inspection portals 52, 54, if maintenance becomes necessary it is possible to insert tools through the portals 52, 54 directly against the wedge bottom 68 so as to force the wedge 10 upwardly. As the working life of the wedge 10 progress and the wedge becomes further inserted with the bottom edge 68 moved below the portals each of the pairs of lifting surfaces 82 and 84 will successively be presented inside each portal 52, 54 and thereby readily accessible for contact by lifting tools.

The foregoing details have been provided to describe a best mode of the invention and further variations and modifications may be made without departing from the spirit and scope of the invention which is defined in the following claims.

What is claimed is:

1. In an articulated connector for a railcar wherein a male member, extending from one car platform, is received and pinned within a pocket in a female member, extending from another car platform, with a bearing block and a wedge shim located within the pocket between the male member nd a pocket end wall and wherein the female member contains inspection portals in pocket sides adjacent said wedge shim, the improvement comprising:

a wedge shim having a tapered body with bearing surfaces extending between a broad top and a narrow bottom; and a tab extending from each side of said tapered body with an indicator groove on each of said tabs and at least one step located between each of said tabs and said bottom of said wedge shim.

2. The apparatus of claim 1 wherein each of said steps includes lifting surfaces parallel to said bottom.

3. An improved wedge shim for a railcar connection, said wedge shim comprising;

a tapered body with bearing surfaces extending between a broad top and a narrow bottom; and a tab extending from each side of said tapered body with an indicator groove on each of aid tabs and at least one step located between each of said tabs and said bottom of said wedge shim.

4. The wedge shim of claim 3 wherein each of said steps includes lifting surfaces parallel to said bottom.

* * * * *